US005618355A

United States Patent [19]

Koyama et al.

[11] Patent Number: 5,618,355

[45] Date of Patent: Apr. 8, 1997

[54] HIGH-STRENGTH STEEL SHEET SUITABLE FOR DEEP DRAWING AND PROCESS FOR PRODUCING THE SAME

[75] Inventors: Kazuo Koyama; Matsuo Usuda; Manabu Takahashi, all of Futtsu; Yasuharu Sakuma, Kimitsu; Shunji Hiwatashi; Kaoru Kawasaki, both of Futtsu, all of Japan

[73] Assignee: Nippon Steel Corporation, Tokyo, Japan

[21] Appl. No.: 556,962

[22] PCT Filed: Apr. 26, 1995

[86] PCT No.: PCT/JP95/00832

§ 371 Date: Dec. 12, 1995

§ 102(e) Date: Dec. 12, 1995

[87] PCT Pub. No.: WO95/29268

PCT Pub. Date: Nov. 2, 1995

[30] Foreign Application Priority Data

Apr. 26, 1994 [JP] Japan ..... 6-088950

[51] Int. Cl.[6] ..... C21D 8/04; C22C 38/02; C22C 38/06

[52] U.S. Cl. ..... 148/320; 148/333; 148/336; 148/603; 148/651

[58] Field of Search ..... 148/603, 651, 148/320, 335, 336, 333

[56] References Cited

U.S. PATENT DOCUMENTS

| | | | |
|---|---|---|---|
| 5,123,971 | 6/1992 | Hook | 148/603 |
| 5,328,528 | 7/1994 | Chen | 148/603 |

FOREIGN PATENT DOCUMENTS

| | | | |
|---|---|---|---|
| 55-158226 | 12/1980 | Japan | 148/603 |
| 61-157625 | 7/1985 | Japan . | |
| 4-325657 | 11/1992 | Japan . | |
| 4-329848 | 11/1992 | Japan . | |
| 5-105986 | 4/1993 | Japan . | |
| 5-112846 | 5/1993 | Japan . | |
| 5-195150 | 8/1993 | Japan . | |
| 5-195143 | 8/1993 | Japan . | |
| 5-271857 | 10/1993 | Japan . | |

OTHER PUBLICATIONS

Teno To Hagne, Effects of Volume Fraction and Stability of Retained Austenite on Ductillity in Trip–Aided Dual Phase Steel Sheets, May 15, 1992.

Sosei To Hako, Journal of the JSTP, vol. 35, No. 404, p. 1109, "Effect of Deformation–Induced Transformation on Deep Drawability" —Forming Mechanism of Trip Type High–Strength Steel Sheet—, Nov. 1, 1993.

*Primary Examiner*—Deborah Yee

*Attorney, Agent, or Firm*—Kenyon & Kenyon

[57] ABSTRACT

A high-strength steel sheet suitable for deep drawing, characterized by comprising 0.04 to 0.25 mass % of C and 0.3 to 3.0 mass %, in total, of at least one of Si and Al, the steel sheet having multiple phases structure comprising ferrite as a main phase (a phase having the highest volume fraction), not less than 3 vol. % of austenite, and bainite and martensite; said steel satisfying a requirement that a value obtained by dividing volume fraction of Vg (vol. %) of austenite before working by the content of C (mass %) contained in the whole steel, Vg/C, is 40 to 140, a requirement that Vp (volume fraction of austenite at the time of plane strain tensile deformation)/Vs (volume fraction of austenite at the time of shrink flanging deformation) is not more than 0.8, and a requirement represented by the formula $$220<Vg\{300(2750Cg+600)/(HfVf+HbVb+HmVm)-1\}<990$$

wherein Cg represents the content of C in austenite; Vf represents the volume fraction of ferrite; Hv represents the hardness; Vb represents the volume fraction of bainite; Hb represents the hardness; Vm represents the volume fraction of martensite before working; and Hm represents the hardness. The high-strength steel sheet is produced under specified production conditions of the temperature on the inlet side of rough rolling (hot rolling), annealing conditions in a two-phase region in the step of continuous annealing after cold rolling, cooling conditions, and bainite transformation treatment conditions.

11 Claims, 2 Drawing Sheets

HIGH-STRENGTH STEEL SHEET SUITABLE FOR DEEP DRAWING AND PROCESS FOR PRODUCING THE SAME

TECHNICAL FIELD

The present invention relates to a high-strength cold-rolled steel sheet comprising multiple phases, having for example, a tensile strength of not less than 440 MPa, and a process for producing the same. Since this steel sheet is suitable for deep drawing and bulging among the fundamental forming modes consisting of various types of press forming, parts having a complicated shape can be easily formed by press forming.

BACKGROUND ART

In recent years, there is an ever-increasing demand for a reduction in the weight of automobile bodies, in addition to the comfort and safety of the automobiles, which requires an increase in the strength of thin steel sheets utilized in automobile structures. Further, in the production of components of the automobile body, simplification, and continuous operation, of the production process by a reduction in the number of forming steps, and by one-body pressing, are considered technical requirements. When the thin steel sheet, among steel products used in such forming, is particularly taken into consideration, the selection criterion of the steel product is that the steel product has good formability. Stretchability, deep drawability, stretch-flange ability, and bendability are also required of the thin steel sheet. In this connection, good deep drawability, in addition to stretchability, is required in order to make it possible to prepare components having a complicated shape, such as interiors of automobiles, requiring only a small number of steps or one-body pressing.

The material properties governing the stretchability are elongation and work hardening coefficient (n value). In recent years, a high-strength multiple phase steel sheet comprising a mixed microstructure of ferrite, bainite, and austenite has been proposed as a steel sheet excellent in the above properties. This steel sheet utilizes "transformation induced plasticity" which is a phenomenon such that austenite remaining at room temperature is transformed to martensite at the time of forming, resulting in high ductility. Japanese Unexamined Patent Publication (Kokai) No. 61-157625 discloses, as a process for producing a high-strength steel sheet, a process for producing a thin steel sheet, such as a steel sheet for automobiles which should be inexpensive and mass-produced. In this prior art, Si is added to inhibit the precipitation of carbides, and ferrite transformation (bainite transformation) at low temperature is allowed to proceed to effectively enrich C in untransformed austenite, thereby stabilizing the austenite. Further, there is a report that the volume fraction and stability of retained austenite are important for providing high ductility in this steel (TETU TO HAGANE, 78 (1992) p.1480). However, no mention is made of deep drawability.

On the other hand, the Lankford value (r value) determined by a uniaxial tensile test, rather than elongation and the n value, is generally used as a material property governing the deep drawability. In general, the deep drawability of a material is tested in terms of deep drawing to a cylindrical cup. It is valuated using a formable range of blank holder force between the minimum force which can restrain wrinkles in the flange portion and the maximum force which can prevent rapture at the shoulder portion of the punch. A material having excellent deep drawability has high breaking proof stress in the shoulder portion of the punch and low shrink flanging deformation resistance in the flange portion. According to the theory of plasticity, a material having a high r value is characterized by having high fracture strength in a deformed state around plain strain in the shoulder portion of the punch and low deformation resistance under shrink flanging deformation in the flange portion. The r value is governed by a texture of the sheet, and, hence, in the development of the conventional deep drawable steel sheet, attention has been drawn mainly to the regulation of the texture. In recent years, however, that a steel utilizing deformation induced transformation of retained austenite has excellent drawability has been reported (SOSEI TO KAKO, 35–404 (1994) p.1109). This suggests that a variation in stability of the retained austenite depending upon the type of deformation is important for the deep drawability of this type of steel.

For a high-strength steel sheet having a tensile strength exceeding 440 MPa, it is difficult to attain a combination of strength with regulation of the texture at a production cost comparable to that of the prior art, and, consequently, no steel sheet having satisfactory deep drawability has been developed in the art. Therefore, the application of a high-strength steel sheet having a tensile strength of not less than 440 MPa to components produced mainly by deep drawing, such as components for inner panels of automobiles, is very difficult. Also in the above Japanese Unexamined Patent Publication (Kokai) No. 61-157625 as prior art, the high-strength steel sheet produced has high ductility and n value, and, hence, among various types of formability, the stretchability is particularly excellent. However, the deep drawability is not studied at all, and the high-strength steel sheet is unsatisfactory for the application thereof to components having a complicated shape requiring deep drawability, such as inner panels of automobiles. Further, in this steel sheet, some types of press forming cause age cracking, of articles prepared by press forming, called "season cracking" or "longitudinal cracking," posing a problem when this steel sheet is applied to press forming involving drawing.

Further, in the deep drawing of a high-strength steel sheet, the load necessary for forming is increased, which causes problems such as lack of loading capacity of a pressing machine and galling caused by sliding under high face pressure. For this reason, materials which, despite high strength, can be formed into articles under low load has been desired in the art.

In "TETSU TO HAGANE, 78 (1992) p.1480" cited above, deep drawability is not studied at all. "SOSEI TO KAKO, 35–404 (1994) p.1109" reports the influence of stability of retained austenite on the deep drawability for steels having tensile strength on the order of 600 MPa. It, however, does not clarify the influence of the volume fraction and hardness of each phase on the deep drawability. Further, the technical problems, such as season cracking, loading capacity of the pressing machine, and galling, remain unsolved.

The present invention has been made with a view to eliminating the above problems, and an object of the present invention is to provide a steel sheet, suitable for deep drawing, which, unlike the conventional high-strength steel sheet, can be deep-drawn at a lower forming load while avoiding the occurrence of galling and season cracking.

The term "steel sheet" as used herein is intended to mean a steel sheet which, in order to improve the conversion treatability, corrosion resistance, and press formability, has been subjected to various treatments such as plating with Ni, Zn, or Cr as a main component, formation of a film of an organic compound or an inorganic compound, or coating of a lubricant.

CONSTRUCTION OF INVENTION

A material having excellent deep drawability is such that the shoulder portion of the punch has high breaking proof stress with the flange portion having low shrink flanging deformation resistance. Materials which exhibit different deformation resistance depending upon deformation mode include those having a high r value exemplified by IF (interstitial free) steels and Al killed steels. The regulation of the texture in the production of these materials enables the materials to already have, before the creation of deformation, a yielding surface which exhibits high yield stress in the plane strain stretch and low yield stress in the shrink flanging deformation. Therefore, they have excellent deep drawability. Since this property is determined almost by the texture before deformation, no problem occurs when evaluation is carried out in terms of the r value determined by monoaxial tensile deformation alone. In a high-strength steel sheet having a tensile strength exceeding 440 MPa, however, it is very difficult to provide a high r value by regulating the texture with limited production steps and costs. In the case of a high-strength steel sheet, the deep drawability should be improved by means other than the improvement in r value by the regulation of the texture.

The present inventors have cold-rolled steel products comprising various chemical compositions and heat-treated the cold-rolled steel sheets to prepare steel sheets comprising ferrite as a main phase and containing austenite at room temperature which were examined for the influence of properties of each phase on the behavior of deformation of the steel products. As a result, it was found that the regulation of the form and properties of each phase can provide a steel sheet having deep drawability at a level which has been unattainable by a conventional high-strength steel sheet having a tensile strength exceeding 440 MPa.

More specifically, the present inventors have found that a high-strength steel sheet having a multiple phases, which contains austenite transformable to martensite by suitable working as described below and has a predetermined relationship between the volume fraction of austenite and the deformation resistance of deformation induced martensite and matrix (ferrite, bainite, and martensite which exists from before working) is effective as a steel sheet having the above contemplated properties.

A phenomenon wherein work hardening is provided by deformation induced martensite transformation of austenite, resulting in markedly improved ductility of a high-strength steel, is known as transformation induced plasticity. The deformation induced transformation is influenced by the amount of deformation (using the corresponding plastic strain as a measure) at the time of working and the deformation mode (in the case of proportional loading, the strain ratio may be used as a measure). In a material wherein austenite is more stable and less likely to cause transformation in shrink flanging deformation than in plain strain tensile deformation, the transformation in the flange portion is slower than that in the shoulder portion of punch. As a result, it is considered that, in the above material, the increase in breaking proof stress by work hardening is large in the shoulder portion of the punch with the increase in deformation resistance by work hardening being small in the flange portion, resulting in excellent deep workability. This effect is more significant when the hardening by transformation is larger. Therefore, the higher the initial volume fraction of austenite and the larger the difference in deformation resistance between work induced martensite and matrix, the better the results.

When the deformation resistance of the flange portion is small, the load necessary for forming may be small and, at the same time, the blank holder load for inhibiting the occurrence of wrinkles may be reduced. This in turn inhibits failures caused by sliding, such as galling, and, at the same time, can reduce the forming load by a reduction in frictional force. The present invention provides a material having the above properties suitable for deep drawing.

Specifically, the high-strength steel sheet of the present invention comprises the following chemical compositions and microstructure.

The steel sheet of the present invention is characterized by comprising 0.04 to 0.25 mass % of C and 0.3 to 3.0 mass % in total of at least one of Si and Al and, if necessary, Mn, Ni, Cu, Cr, Mo, Nb, Ti, V, and P, with the balance consisting of Fe and unavoidable impurities, and having a multiple phases comprising ferrite as a main phase (a phase having the highest volume fraction), not less than 3 vol. % of austenite, and bainite and martensite; said steel having multiple phases having a ratio of a volume fraction of austenite Vp (vol. %), after plane strain tensile deformation, (which is a volume fraction of austenite remaining when plane strain tensile deformation (strain ratio=(minimum principal strain within plane)/(maximum principal strain within plane)=0) is applied until a corresponding plastic strain of 1.15 times Eu (logarithmic strain of uniform elongation in the case of uniaxial tension) is imparted to a volume fraction of austenite Vs (vol. %), after shrink flanging deformation, (which is a volume fraction of austenite remaining when shrink flanging deformation (strain ratio=−4 to −1) is applied until a equivalent plastic strain of 1.15Eu is imparted), Vp/Vs, of not more than 0.8; and said steel having multiple phases satisfying a requirement represented by the following formula $$220<Vg\{300(2750Cg+600)/(HfVf+HbVb+HmVm)-1\}<990$$

wherein Vg represents the volume fraction of austenite before working (vol. %); Cg represents the content of C in the austenite (mass %); Vf represents the volume fraction of ferrite before working (vol. %); Hf represents the microvickers hardness of the ferrite; Vb represents the volume fraction of bainite before working (vol. %); Hb represents the hardness of the bainite; Vm represents the volume fraction of martensite before working (vol. %); and Hm represents the hardness of the martensite. It is further characterized in that in said multiple phases a value obtained by dividing the volume fraction Vg (vol. %) of austenite before working by the content of C (mass %) in the whole steel, Vg/C, is in the range of from 40 to 140.

The present invention further provides a process for producing the above high-strength steel sheet, which process comprises: casting a molten steel comprising the above constituents into a slab; either cooling and then heating the slab to a temperature above 1100° C. or ensuring a temperature above 1100° C. on the inlet side of rough rolling without cooling to carry out hot rolling; coiling the resultant hot-rolled strip at a temperature in the range of from 350° to 750° C. ; transferring the hot-rolled steel strip into a continuous annealing furnace where the steel strip is heated in the temperature range of from $A_{C1}$ to $A_{C3}$ for 30 sec to 5 min, cooled to 550° to 720° C. at a cooling rate of from 1° to 200° C./sec, further cooled to the temperature range of from 250° to 500° C. at a cooling rate of from 10° to 200° C./sec, held in the temperature range of from 300° to 500° C. for 15 sec to 15 min, and then cooled to room temperature.

The high-strength steel sheet of the present invention shows the so-called transformation induced plasticity and high degree of stretchability, as a result of deformation induced plasticity by appropriate degree of deformation described below in tensile deformation having a problem of necking. Therefore, the high-strength steel sheet of the present invention exhibits very good formability in general press forming involving a combination of deep drawing with bulging.

BEST MODE FOR CARRYING OUT THE INVENTION

Figure 1:
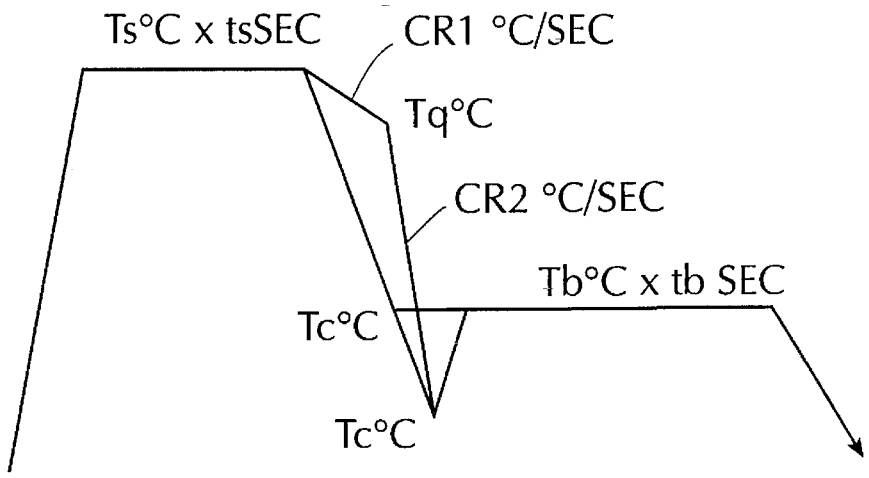
FIG. 1 is a conceptual diagram of a heat cycle in annealing after cold rolling in the production of the steel of the present invention.

At the outset, individual elements important to the steel of the present invention will be described.

(1) Volume fraction of each phase

Work hardening of a steel containing austenite is considered to comprise two factors, i.e., general work hardening which can be explained by the behavior of dislocation and hardening by deformation induced martensite transformation. Increasing the volume fraction of austenite can increase the region of transformation hardening and, hence, can improve the deep drawability of the steel sheet. However, the main phase (the phase having the highest volume fraction) should be ferrite of sufficiently soft even after deformation. This is important from the viewpoint of deep drawability, as well as from the viewpoint of avoiding season cracking of articles produced by deep drawing. When the amount of martensite produced by deformation induced transformation is large with the amount of ferrite being small, the residual stress attributable to volume expansion at the time of transformation cannot be sufficiently relaxed by plastic deformation of the soft matrix, so that season cracking is likely to occur. For this reason, the ferrite should constitute the main phase.

Due to the nature of the production process, the formation of bainite or martensite is unavoidable. However, the smaller the amount of the bainite and martensite formed, the better the results. Since bainite and martensite are harder than ferrite, the matrix (the phases, other than austenite, which exist from before working) is hardened. For this reason, the hardening by transformation becomes so small that the deep drawability is deteriorated. In addition, the matrix cannot sufficiently absorb the residual stress attributable to volume expansion, and the season cracking resistance is also deteriorated. For this reason, the smaller the amounts of bainite and martensite which exist before working, the better the results.

Although the influence of the volume fraction of austenite on the deep drawability varies also with the difference in deformation resistance between the deformation induced martensite and the matrix, the deep drawability increases with increasing the amount of austenite. However, when the volume fraction of austenite exceeds 30%, the austenite becomes so unstable that the deep drawability is deteriorated, or otherwise the volume fraction of the ferrite is relatively reduced, so that season cracking is likely to occur in the formed article. The volume fraction of the austenite attained by the production process of the present invention is below 30%, and an attempt to increase the volume fraction to a value more than that results in markedly increased production cost. For this reason, the upper limit of the volume fraction of austenite in the present invention is preferably 30%. When the volume fraction of austenite is less than 3%, the deep drawability is saturated, making it impossible to attain an effect better than the effect of a high-strength steel having a high r value (solid-solution strengthened IF steel) on the same strength level provided by the conventional regulation of texture, even though the difference in deformation resistance between the martensite and the parent phase is large. For this reason, the lower limit of the volume fraction of austenite is 3%. In this connection, it should be noted that, as described above, the deep drawability is influenced also by the difference in deformation resistance (hardness) between the martensite formed by deformation induced transformation and the parent phase. When the volume fraction of austenite before working, the deformation resistance of deformation induced martensite and matrix are taken into consideration, the deep drawability is preferably evaluated using the formula $Vg\{300(2750Cg+600)/(HfVf+HbVb+HmVm)-1\}$. This will described in detail later. Further, when the importance of stability of austenite against working is taken into consideration, it is preferred that Vg/C falls within a particular range. This will also be described in more detail later.

(2) Deformation mode dependency on stability of austenite against working

Figure 3:
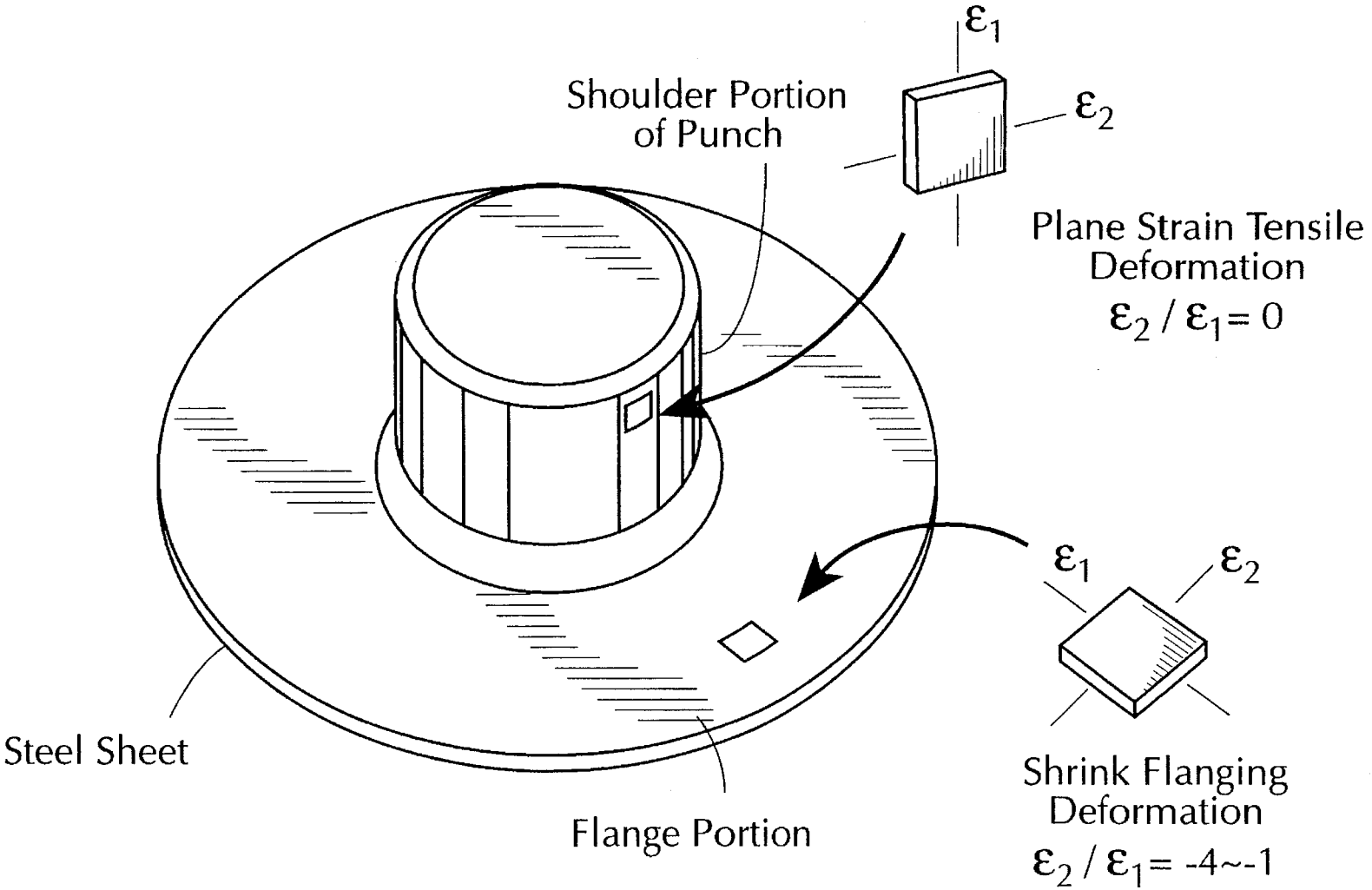
FIG. 3 is a typical diagram showing the state of deformation at the time of deep drawing.

As described above, the steel sheet having excellent deep drawability is characterized by having high fracture strength at the shoulder portion of the punch and low drawing resistance. The present invention has attained this by taking advantage of the difference in behavior of work hardening depending upon the state of deformation. The work hardening of a steel containing austenite is considered to comprise two factors, i.e., general work hardening which can be explained by the behavior of dislocation and hardening by deformation induced martensite transformation. The former is work hardening found in the conventional steel, and it has been experimentally found that the dependency of the behavior on the deformation mode is relatively small. From the viewpoint of theory of plasticity, in general, work hardening is, in many cases, unconditionally defined as a relationship between the equivalent stress and the equivalent plastic strain. Deformation analysis in such treatment has relatively good accuracy. On the other hand, hardening based on deformation induced martensite transformation varies greatly upon the deformation mode. As shown in FIG. 3, transformation is likely to occur in the plane strain tensile deformation at the shoulder of the punch. On the other hand, in the shrink flanging deformation in the flange portion, the progression of transformation is inhibited. For this reason, work hardening is large in the plain strain tensile deformation at the shoulder portion of the punch, resulting in high stress. On the other hand, in the shrink flanging deformation of the flange portion, the work hardening is so small that the drawing resistance is low.

The steel of the present invention utilizes hardening based on deformation induced martensite transformation and has the above properties in the plain strain tensile deformation and shrink flanging deformation and very good deep drawability.

Specifically, in the steel of the present invention, the ratio of the volume fraction of austenite after plain strain tensile deformation, Vp (vol. %), to the volume fraction of austenite after shrink flanging deformation, Vs (vol. %), i.e., Vp/Vs, is not more than 0.8, thereby differentiating the deformation (plain strain tension) at the shoulder portion of the punch from work hardening in deformation mode (shrink flanging deformation) in the flange portion, thus ensuring a deformation resistance difference high enough to enable satisfactory deep drawing.

In this connection, the volume fraction of austenite after plain strain tensile deformation, Vp, is the volume fraction of austenite remaining when plane strain tensile deformation (strain ratio=(minimum principal strain within plane)/(maximum principal strain within plane)=0) is applied to the steel sheet until a equivalent plastic strain of 1.15 times Eu (logarithmic strain of uniform elongation in the case of uniaxial tension) is imparted, and the volume fraction of austenite after shrink flanging deformation, Vs, is the volume fraction of austenite remaining when shrink flanging deformation (strain ratio=−4 to −1) is applied to the steel sheet until a corresponding plastic strain of 1.15Eu is imparted.

The above strain ratio is the ratio of the maximum main strain in the deformation within the plane, $\epsilon 2$, to the minimum main strain, $\epsilon 2$, that is, $\epsilon 2/\epsilon 1$. The strain ratio in the plane strain tensile deformation becomes zero (0). The strain ratio in the shrink flanging deformation varies depending upon forming conditions and shape of formed articles. It, however, is generally in the range of from −4 to less than −1 and, therefore, defined in this range. As described above, a corresponding plastic strain which is 1.15 times the logarithmic Eu was adopted as the strain for evaluating the volume fraction of austenite. According to plastic instability theory, the plastic instability point in the plain strain tensile deformation is $2n/3^{1/2}$ of the equivalent plastic strain. Since n is in agreement with uniform elongation in uniaxial tension, $2Eu/3^{1/2}$, i.e., 1.15Eu, is suitable for providing the maximum load (fracture strength) in the plane strain tension. On the other hand, the strain in the flange portion for providing the maximum load cannot be unconditionally determined because it is strongly influenced by forming conditions and shapes of formed articles. For many types of deep drawing, however, in the vicinity of the maximum load, the equivalent plastic strain in the portion which undergoes the largest shrink flanging deformation may be considered to exceed 1.15Eu. At least when the equivalent plastic strain is 1.15Eu and there is no sufficient difference in behavior of transformation, the austenite is so unstable that a slight deformation brings about almost complete deformation, or otherwise the austenite is so stable that little or no deformation occurs even though deformation is applied to any extent. Therefore, no sufficient difference in behavior of transformation occurs even though the strain exceeds a value which raises a problem in the deep drawing. For this reason, the behavior of transformation may be compared when the equivalent plastic strain is 1.15Eu.

In this case, sufficient difference in behavior of transformation in a equivalent plastic strain of 1.15Eu refers to Vp/Vg being not more than 0.8. The present inventors have found that, when this value is close to 1, the austenite is so unstable that a slight deformation brings about almost complete deformation, or otherwise the austenite is so stable that little or no deformation occurs even though deformation is applied to any extent. The present inventors have further made extensive and intensive studies and, as a result, have found that, when Vp/Vs exceeds 0.8, work hardening in the deformation mode at the shoulder portion of the punch becomes equal to the work hardening in the deformation mode in the flange portion, making it difficult to ensure deformation resistance difference large enough to provide satisfactory deep drawability. Even in the case of steels falling within the scope of the present invention, if Vp/Vs exceeds 0.8, the austenite becomes so unstable that almost complete transformation occurs also in the shrink flanging deformation portion. In this case, even though necessary deep drawability could be ensured, season cracking in many cases occurs. For this reason, the upper limit of Vp/Vs is 0.8.

(3) Deformation resistance of matrix and martensite

The present inventors have made extensive and intensive studies and, as a result, have found that the above effect is influenced by the deformation resistance ratio of matrix to deformation induced martensite. Specifically, it has been found that, in the steel of the present invention, the larger the hardening by transformation than by dislocation behavior, the larger the deformation mode dependency and therefore, the larger effect on the deep drawability. Furthermore, examination of the season cracking from a similar viewpoint has revealed that, as compared with the deformation induced martensite, a softer matrix provides better season cracking resistance after deep drawing.

In order to increase the proportion of the hardening by transformation, the amount of transformable austenite is also important in addition to the above deformation resistance. The present inventors have elucidated that both the ratio of the deformation resistance of the matrix to the deformation resistance of the martensite created by deformation and the amount of the austenite existing before the working should be taken into consideration for judging the deep drawability and clarified that they should satisfy the following relationship:

$$220<Vg\{300(2750Cg+600)/(HfVf+HbVb+HmVm)-1\}<990$$

Figure 2:
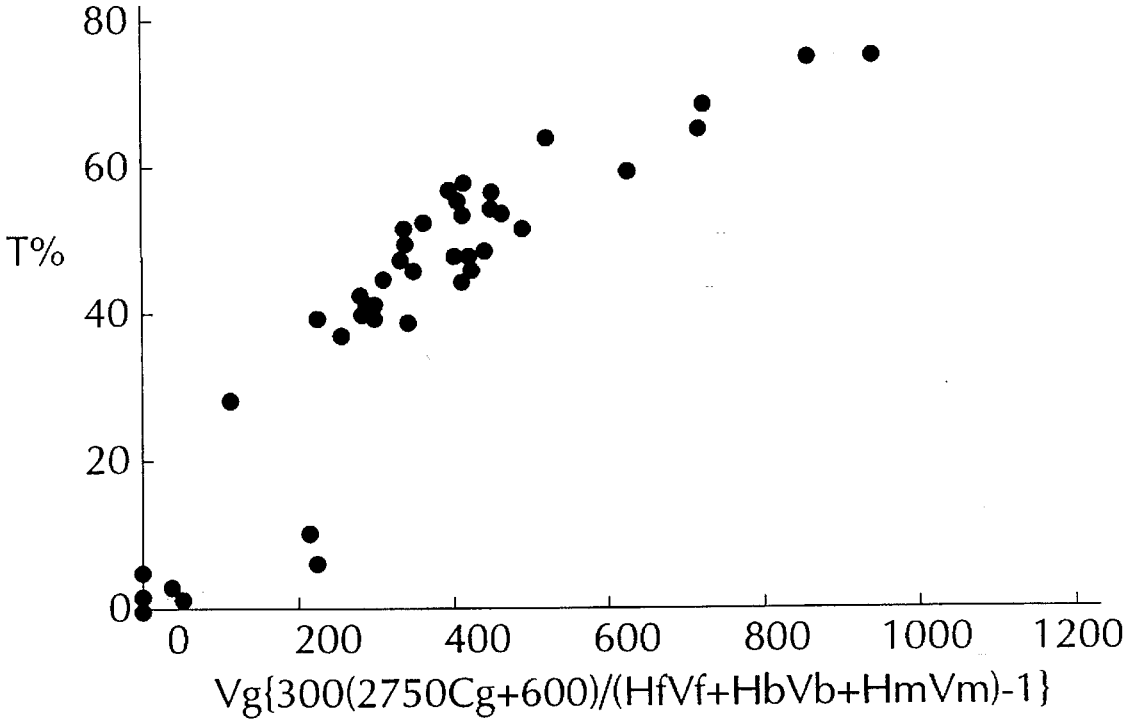
FIG. 2 is a diagram showing the relationship between the formula $Vg\{300(2750Cg+600)/(HfVf+HbVb+HmVm)-1\}$ and the deep drawability (T value)

In this case, the deformation resistance of the martensite created by work induced deformation was assumed to be proportional to the concentration of C in the austenite and expressed by (2750Cg+600)MPa (see W. C. Leslie, in Strengthening Mechanisms, Metal and Ceramics (Burke, Reed, and Weiss, eds.), Syracuse Univ. Press, Syracuse, N.Y., 1966, p46.). Further, (HfVf+HbVb+HmVm)/300 (MPa) was used as the deformation resistance of the matrix. The Hf can be determined by measuring the microvickers hardness of ferrite grains. It is generally difficult to directly measure Hb and Hm because grains are small. Prediction by taking into consideration the chemical composition and the production process is also not easy. As a result of extensive and intensive studies of the present inventors, it has been found that, when Hb and Hm were assumed to be respectively 300 and 900, the above formula has correlation with the deep drawability and the season cracking independently of the chemical composition and the production process. In fact, in the present invention, ferrite constitutes a main phase. Bainite and martensite are unavoidable phases due to the nature of the process. However, the smaller the bainite and martensite contents, the better the phase. Therefore, the influence of these phases on the deformation resistance of the matrix is relatively small. Therefore, the assumed values 300 and 900 suffice respectively for Hb and Hm. As can be seen from FIG. 2, Vg thus obtained has good correlation with the T value as a measure of the deep drawability.

The T value is expressed by T=(Pf−Pm)/Pm wherein Pm represents the maximum drawing load in the initial blank holder force; and Pf represents the breaking load when the blank holder force is enhanced afterward to forcibly cause reputure of the shoulder of the punch.

In this case, Vg{300(2750Cg+600)/(HfVf+HbVb+HmVm)−1} should exceed 220. As described above, Vg should be at least 3%. This is on the premise that the deformation resistance ratio of the matrix to the martensite is sufficiently high. Specifically, even in the case of a Vg value of 3%, if the deformation resistance ratio 300(2750Cg+600)/(HfVf+HbVb+HmVm) is small and Vg{300(2750Cg+600)/(HfVf+HbVb+HmVm)−1} is below 220, it is impossible to provide transformation hardening sufficient to improve the deep drawability and matrix sufficiently soft for season cracking resistance. For this reason, the lower limit of Vg{300(2750Cg+600)/(HfVf+HbVb+HmVm)−1} is 220.

On the other hand, when Vg is constant, the larger the 300(2750Cg+600)/(HfVf+HbVb+HmVm), the better the deep drawability. Since, however, the deformation resistance of martensite is determined by the concentration of C in austenite before transformation, Cg (mass %), the upper limit exists in fact. The enrichment of C in the austenite in a larger amount than required, resulting in softening of the matrix, leads to an increase in production cost and, hence, is unrealistic from the viewpoint of the chemical compositions and the production process of the steel of the present invention. Vg obtained in the present invention is less than 30%, and there is a limitation on an increase in both Vg and Cg. For the reasons set out above, an enhancement of Vg {300(2750Cg+600)/(HfVf+HbVb+HmVm)−1} to an unnecessary high extent is unrealistic, and, hence, the upper limit of Vg{300(2750Cg+600)/(HfVf+HbVb+HmVm)−1} is 990.

(4) Vg/C

The volume fraction of austenite in the steel sheet before working, Vg (vol. %), and the enrichment of C in the austenite are important to a further improvement in the formability such as deep drawability and stretchability of the steel of the present invention. In general, the amount of austenite finally obtained increases with increasing the average C content of the steel sheet. In this case, the presence of austenite in an amount larger than required lowers the C content of the austenite, resulting in deteriorated stability of the austenite. When the value Vg/C obtained by dividing the amount of austenite, Vg, by C (mass %) exceeds 120, the stability of austenite is deteriorated. This deteriorates the stretchability of the steel sheet and, further, increases Vp/Vs, resulting also in a deteriorated deep drawability. For this reason, the upper limit of Vg/C is 120. According to experiments conducted by the present inventors, the content of C in the austenite cannot be increased indefinitely. In the possible enrichment range, the higher the C content of the austenite, the better the deep drawability of the steel sheet. However, when Vg is lowered to give a Vg/C value of less than 40, martensite, cementite, and the like are formed to harden the parent phase, resulting in lowered value of Vg{300(2750Cg+600)/(HfVf+HbVb+HmVm)−1). This in turn results in markedly deteriorated deep drawability, season cracking resistance, and stretchability of the steel sheet. For this reason, the lower limit of Vg/C is 40.

(5) Chemical compositions

C content:

C is one of the most important elements in the present invention for stabilizing austenite, without use of any expensive alloying element, and leaving the austenite at room temperature. The stabilization of austenite can be attained by increasing the C content of the austenite by taking advantage of the transformation from austenite to ferrite through heat treatment. C affects the volume fraction of austenite, and, further, the enrichment of C in the austenite increases the stability of the austenite and increases the deformation resistance of deformation induced martensite. When the average C content is less than 0.04 mass %, the volume fraction of austenite finally obtained is 2 to 3% at the highest, resulting in lowered stability of the austenite or relatively small deformation resistance of the deformation induced martensite. That is, Vg/C is less than 40 or Vp/Vs exceeds 0.8 or Vg{300(2750Cg+600)/(HfVf+HbVb+HmVm)−1) is not more than 220, so that neither satisfactory deep drawability and season cracking nor stretchability and ductility can be expected. For this reason, the lower limit of the amount of C added is 0.04 mass %. The maximum retained austenite volume fraction increases with increasing the average C content. Although this stabilizes the austenite, the weldability is deteriorated. In particular, the deterioration of the weldability is significant at C>0.23 mass %. For this reason, the upper limit of the amount of C added is 0.23 mass %.

Si and Al contents:

Si and Al are both ferrite stabilizing elements and useful for producing a steel sheet comprising ferrite as a main phase as contemplated in the present invention. Further, both Si and Al inhibit the formation of carbides such as cementite, thus preventing waste of C. However, when the amount of these element is not more than 0.3 mass % in terms of the amount of one element when a single element is added, or the total amount when both the elements are added, carbides and martensite are likely to form, which causes hardening of the matrix and, at the same time, a reduction in amount of austenite or almost complete transformation at an early stage of forming occurs. That is, the volume fraction of austenite is less than 3% or Vg/C is less than 40 or Vp/Vs exceeds 0.8 or Vg{300(2750Cg+600)/(HfVf+HbVb+HmVm)−1} is not more than 220, so that neither satisfactory deep drawability nor ductility and stretchability can be expected. For this reason, the lower limit of the amount of Si and Al added is 0.3 mass % in terms of the amount of one element when a single element is added, or the total amount when both the elements are added.

When the amount of Si and Al added exceeds 3.0 mass % in terms of the amount of one element when a single element is added, or the total amount when both the elements are added, the deformation resistance of matrix becomes so high that the effect of improving deep drawability is unsatisfactory, the toughness is markedly lowered, the steel product cost is increased, and the conversion treatability is deteriorated (in the case of Si). For this reason, the upper limit of the above amount is 3.0 mass %.

Mn, Ni, Cu, Cr, and Mo contents:

As with Si and Al, these elements serve to delay the formation of carbides and, hence, are additive elements which serve to leave austenite. In addition, these alloying elements enhance the stability of austenite and, hence, are useful for reducing the shrink flanging deformation resistance. That is, when there is a limitation on the C content from the viewpoint of weldability, the use of these elements is effective. However, when the total amount of these elements is less than 0.5 mass %, the effect is unsatisfactory. That is, in the case of low C content, the volume fraction of austenite is less than 3% or Vg/C is less than 40 or Vp/Vs exceeds 0.8 or Vg{300(2750Cg+600)/(HfVf+HbVb+

HmVm)−1} is not more than 220, so that neither deep drawability nor ductility and stretchability can be expected. For this reason, the lower limit of the total amount of these additive elements is 0.5 mass %.

On the other hand, when the total amount of these alloying elements added exceeds 3.5 mass %, the parent phase is hardened, resulting in lowered contribution of the transformation to the deep drawability (Vg{300(2750Cg+600)/(HfVf+HbVb+HmVm)−1} being not more than 220), and, at the same time, the steel production cost is increased. Therefore, the upper limit of the total amount of these alloying elements added is 3.5 mass %.

Nb, Ti, and V contents:

These elements form carbides, nitrides or carbonitrides and are useful for strengthening the steel product. However, the addition thereof in a total amount exceeding 0.2 mass % is unfavorable because the steel product cost is increased, the deformation resistance of the matrix is increased to a higher extent than required, and C is wasted. That is, the volume fraction of austenite is less than 3% or Vg/C is less than 40 or Vp/Vs exceeds 0.8 or Vg{300(2750Cg+600)/(HfVf+HbVb+HmVm)−1}is not more than 220, so that neither deep drawability nor ductility and stretchability can be expected. For this reason, the upper limit of the total amount of these elements is 0.2 mass %.

P content:

P is an inexpensive additive element which is effective for strengthening the steel product. However, when P is added in an amount exceeding 0.2 mass %, the steel product cost is increased and, at the same time, the deformation resistance of ferrite is increased to a higher extent than required. As a result, Vg{300(2750Cg+600)/(HfVf+HbVb+HmVm)−1} becomes not more than 220, making it impossible to attain good deep drawability. Further, the deterioration of season cracking becomes significant. Therefore, the upper limit of the P content is 0.2 mass %.

(6) Production process

A steel in which the chemical compositions have been regulated according to the above requirements is cast into a slab which is then cooled to room temperature, reheated to a temperature above 1100° C. and hot-rolled. Alternatively, the slab may be hot-rolled without cooling while ensuring a temperature above 1100° C. on the inlet side of rough rolling. Both the above methods can provide the microstructure and properties falling within the scope of the present invention. In the reheating of the cooled slab, if the reheating temperature is 1100° C. or below and the temperature above 1100° C. on the inlet side of rough rolling cannot be ensured, inclusions, such as MnS, are finely dispersed, causing the matrix of a product to be hardened. That is, since Vg{300(2750Cg+600)/(HfVf+HbVb+HmVm)−1} is not more than 220, the deep drawability and season cracking are deteriorated. For this reason, the lower limit of the heating temperature and the temperature on the inlet side of rough rolling is 1100° C. Also in the case of hot rolling of the slab without cooling, when the temperature above 1100° C. cannot be ensured on the inlet side of rough rolling, the deep drawability and the season cracking are deteriorated for the same reason. Therefore, the lower limit of the temperature on the inlet side of rough rolling is 1100° C. In order to avoid this, it is possible to regulate the temperature in a heating furnace according to the temperature of the slab on the inlet side of the step of hot rolling.

After hot rolling, the steel strip is coiled. When the coiling temperature is below 350° C., the strength of the hot-rolled steel sheet becomes high, increasing the load of cold rolling thereby to lower the productivity and, at the same time, causing cracking at the end of the steel sheet in the widthwise direction thereof in the course of cold rolling. For this reason, the lower limit of the coiling temperature is 350° C. On the other hand, when the coiling temperature exceeds 750° C., austenite stabilizing elements, such as Mn, are enriched in a larger amount than required in the pearlite of the hot-rolled steel sheet, which inhibits the formation of ferrite in the step of annealing after cold rolling and, at the same time, results in an increased variation in the quality of the material in the longitudinal direction of the coil. For this reason, the upper limit of the coiling temperature is 750° C.

In subsequent cold rolling, when the reduction ratio in the cold rolling is less than 35%, no homogeneous recrystallized ferrite microstructure can be obtained and the variation in quality and anisotropy of the material become large. For this reason, the lower limit of the reduction ratio in the cold rolling is 35%. On the other hand, when the reduction ratio in the cold rolling exceeds 85%, the load in the step of cold rolling is excessively increased, leading to increased total cost. Therefore, the upper limit of the reduction ratio in the cold rolling is 85%.

In the step of annealing, a contemplated microstructure can be formed by heating to a two-phase region of ferrite +austenite of $A_{C1}$ to $A_{C3}$. In the case of heating to below $A_{C1}$, residual austenite is not obtained at all. On the other hand, in the case of heating to above $A_{C3}$, it is difficult to control the volume fraction of ferrite by cooling. For this reason, the upper limit and the lower limit of the temperature are respectively $A_{C1}$ and $A_{C3}$.

Cooling after heating to the two-phase region is carried out in two stages. In the first stage, since it is difficult to practically attain a cooling rate of less than 1° C./sec or a cooling rate exceeding 200° C./sec, the lower limit and the upper limit of the cooling rate are respectively 1° C./sec and 200° C./sec. In this case, gradual cooling can accelerate the ferrite transformation, thereby stabilizing austenite. Therefore, the cooling rate in the first stage is preferably 1° C./sec to 10° C./sec. In such gradual cooling, the cooling in the first stage should be terminated in the temperature range of from 550° to 720° C. When the cooling termination temperature is above 720° C., the effect of gradual cooling in the first stage cannot be attained. Therefore, the upper limit of the cooling termination temperature in the first stage is 720° C. On the other hand, when the cooling termination temperature is below 550° C., pearlite deformation proceeds during gradual cooling (the matrix is hardened), resulting in waste of C necessary for the stabilization of austenite. That is, the volume fraction of austenite is less than 3% or Vg/C is less than 40 or Vp/Vs exceeds 0.8 or Vg{300(2750Cg+600)/(HfVf+HbVb+HmVm)−1} is not more than 220, so that neither good deep drawability nor good ductility and stretchability can be expected. For this reason, the lower limit of the cooling termination temperature in the first stage is 550° C.

Subsequent cooling in the second stage should be carried out at a high cooling rate in order to avoid the formation of pearlite. When the cooling rate is less than 10° C./sec, the pearlite deformation proceeds during cooling (the matrix is hardened), resulting in waste of C necessary for the stabilization of austenite. This again deteriorates the deep drawability of the steel sheet. Therefore, the lower limit of the cooling rate in the second stage is 10° C./sec. Here again, the upper limit of the cooling rate is 200° C./sec from the practical viewpoint. When this cooling is carried out until the temperature reaches less than 250° C., the austenite remaining untransformed is transformed to martensite to harden the matrix, deteriorating the deep drawability. For this reason, the lower limit of the cooling termination temperature is 250° C. On the other hand, when the cooling termination temperature in the second state exceeds 500° C., the transformation of bainite including cementite proceeds, resulting in a waste of C as in the case of the formation of pearlite. That is, the volume fraction of austenite is less than 3% or Vg/C is less than 40 or Vp/Vs exceeds 0.8 or Vg{300(2750Cg+600)/(HfVf+HbVb+HmVm)−1} is not more than 220, so that the deep drawability and season cracking resistance are deteriorated. For this reason, the upper limit of the cooling termination temperature in the second stage is 500° C.

After cooling to the above temperature, the enrichment of C in the austenite is accelerated by bainite transformation. The properties of the final steel sheet are not changed when the temperature for the bainite transformation is identical to the cooling termination temperature or when it is above the cooling termination temperature, so far as it is in the range from 300° to 500° C. In this case, when the bainite transformation treatment is carried out at a temperature below 300° C., hard bainite close to martensite or martensite per se is formed, which increases the deformation resistance of the matrix to a higher extent than required and, at the same time, brings about the precipitation of carbides, such as cementite, in bainite, resulting in waste of C. That is, the volume fraction of austenite is less than 3% or Vg/C is less than 40 or Vp/Vs exceeds 0.8 or Vg{300(2750Cg+600)/(HfVf+HbVb+HmVm)−1} is not more than 220, so that the deep drawability and season cracking resistance are deteriorated. For this reason, the lower limit of the bainite transformation treatment temperature is 300° C. On the other hand, when the bainite transformation treatment temperature exceeds 500° C., as described above, the transformation of bainite including cementite proceeds, resulting in waste of C as in the case of the formation of pearlite. That is, Vg/C is less than 40 or Vp/Vs exceeds 0.8 or Vg{300(2750Cg+600)/(HfVf+HbVb+HmVm)−1} is not more than 220. For this reason, the upper limit of the bainite transformation treatment temperature is 500° C. Holding in this temperature range is carried out at a constant temperature or by gradual cooling in this temperature range. When the holding time is less than 15 sec, the enrichment of C in the austenite is unsatisfactory, resulting in increased martensite which in turn increases the deformation resistance of the matrix. That is, the volume fraction of austenite is less than 3% or Vg/C is less than 40 or Vp/Vs exceeds 0.8 or Vg{300(2750Cg+600)/(HfVf+HbVb+HmVm)−1} is not more than 220, so that the deep drawability and season cracking resistance are deteriorated. For this reason, the lower limit of holding time is 15 sec. On the other hand, when the holding time exceeds 15 min, the precipitation of carbides, such as cementite, occurs from austenite with C being enriched. This reduces the amount of retained austenite and increases the hardness of the matrix. Here again, the deep drawability and the season cracking resistance are deteriorated. Therefore, the upper limit of the holding time is 15 min.

Among the above steps, annealing heat cycle after cold rolling is shown in FIG. 1. In the drawing, Ts° C. : holding temperature in the two-phase region ($A_{c1}$ to $A_{C3}$), ts sec: holding time in the two-phase region (30 sec to 5 min), $CR_1$°C./sec: cooling time in the first stage (1° to 200° C./sec), Tq°C. : cooling termination temperature in the first stage (550° to 720° C. ), $CR_2$° C./sec: cooling rate in the second stage (10° to 200° C./sec), Tc° C. : cooling termination temperature in the second stage (250° to 500° C./sec), Tb°C.: bainite treatment temperature (300° to 500° C.), and tb sec: bainite treatment time (15 sec to 15 min).

EXAMPLES

Steels comprising ingredients specified in Table 1 were subjected to a series of treatments specified in Table 2, and the treated steels were evaluated for mechanical properties, deep drawability, the content of austenite, and the content of C in the austenite. The results are given in Table 2.

The volume fraction of austenite was determined from the integration intensity of (200) and (211) planes of ferrite and (200), (220), and (311) planes of austenite using the Ka line of Mo. Vp and Vs in Table 2 represent respectively the volume fractions of austenite in corresponding plastic strain 1.15Eu in plane strain tensile deformation and shrink flanging deformation. Vg represents the volume fraction of austenite at room temperature before deformation. The concentration of C in austenite and Cg (mass %) were measured by measuring the angle of reflection of (002), (022), (113), and (222) planes of austenite using Kαline of Co, and the lattice constant was determined by the following relational expression:

$$\text{Lattice constant}=3.572+0.033Cg$$

In Table 2, Cg % marked with * represents examples where the Cg % is immeasurable because austenite is absent or present in only a very small amount.

Vf, Vb, and Vm were determined from a photomicrograph, and Hf is a microvickers hardness. Hb was 300, and Hm was 900.

In the column of Vg{300(2750Cg+600)/(HfVf+HbVb+HmVm)−1}, * represents examples where Cg was immeasurable.

The deep drawability was evaluated in terms of T value in TZP test using a tool for deep-drawing a cylinder having a diameter of 50 mm. In this case, the blank was in the form of a circle having a diameter of 96 mm, a rust preventive oil was used for lubrication, the initial blank holder force was 0.9 ton, and the blank holder force after the maximum drawing load point was 19 tons. In the column of T value ( %) of Table 2, ** represents examples where rupture occurred before the maximum drawing load point or the fracture load was lower than the maximum drawing load, indicating that the deep drawability is poor.

In Tables 1 and 2, underlined numerical values represent examples outside the scope of the invention. From Table 2, it is apparent that steel sheets satisfying the requirements of the present invention have excellent drawability by virtue of high T value. Further, it is apparent that, when T value is high, the forming load can be reduced for the strength. This is advantageous also from the viewpoint of preventing galling.

For steel sheets wherein the value of Vg{300(2750Cg+600)/(HfVf+HbVb+HmVm)−1} is outside the scope of the present invention and steel sheet wherein Vg/C exceeds the upper limit specified in the present invention, season cracking occurred in an article prepared by drawing at a draw ratio of 1.7. Further, steels wherein Vp/Vs or Vg{300(2750Cg+600)/(HfVf+HbVb+HmVm)−1} is outside the scope of the present invention had a low T value or poor season cracking resistance.

Thus, it is apparent that the steels of the present invention had excellent deep drawability and season cracking resistance and, therefore, are suitable for deep drawing.

Both a test piece of No. 17, wherein the value of Vg{300(2750Cg+600)/(HfVf+HbVb+HmVm)−1} is outside the scope of the invention although Vp/Vs falls within the scope of the present invention, and a test piece of No. 20; wherein Vp/Vs is outside the scope of the invention although the value of Vg{300(2750Cg+600)/(HfVf+HbVb+HmVm)−1} falls within the scope of the present invention, had a low T value ( %) and caused season cracking.

TABLE 1

| Steel | C | Si | Mn | Al | Ni | Cu | Cr | Mo | Nb | Ti | V | (Mass %) Remarks |
|---|---|---|---|---|---|---|---|---|---|---|---|---|
| A | 0.03 | 1.20 | 1.50 | 0.02 | | | | | | | | Comp. steel |
| B | 0.05 | 1.90 | 1.60 | 0.03 | | | | | | | | Steel of inv. |
| C | 0.08 | 1.80 | 1.60 | 0.02 | | | | | | | | Steel of inv. |
| D | 0.10 | 0.20 | 2.00 | 0.02 | | | | | | | | Comp. steel |
| E | 0.10 | 1.20 | 1.50 | 0.04 | | | | | | | | Steel of inv. |
| F | 0.10 | 1.50 | 1.50 | 0.03 | | | | | | | | Steel of inv. |
| G | 0.10 | 3.20 | 1.50 | 0.02 | | | | | | | | Steel of inv. |
| H | 0.16 | 1.20 | 1.00 | 0.03 | | | | | | | | Steel of inv. |
| I | 0.20 | 1.50 | 1.50 | 0.04 | | | | | | | | Steel of inv. |
| J | 0.23 | 1.80 | 1.50 | 0.03 | | | | | | | | Steel of inv. |
| K | 0.32 | 1.20 | 2.00 | 0.02 | | | | | | | | Comp. steel |
| L | 0.36 | 1.20 | 1.50 | 0.03 | | | | | | | | Comp. steel |
| M | 0.10 | 0.02 | 1.50 | 0.50 | | | | | | | | Steel of inv. |
| N | 0.10 | 0.02 | 1.50 | 1.50 | | | | | | | | Steel of inv. |
| O | 0.19 | 0.50 | 1.50 | 1.50 | | | | | | | | Steel of inv. |
| P | 0.19 | 1.30 | 1.50 | 1.50 | | | | | | | | Steel of inv. |
| Q | 0.10 | 1.50 | 0.70 | 0.02 | 0.80 | | | | | | | Steel of inv. |
| R | 0.10 | 1.50 | 0.50 | 0.03 | | 1.00 | | | | | | Steel of inv. |
| S | 0.10 | 0.40 | 1.50 | 0.02 | 0.50 | 0.80 | | | | | | Steel of inv. |
| T | 0.10 | 1.00 | 0.50 | 0.03 | | | 0.80 | | | | | Steel of inv. |
| U | 0.10 | 1.00 | 0.40 | 0.03 | | | | 0.60 | | | | Steel of inv. |
| U' | 0.10 | 1.00 | 0.40 | 0.03 | | | | | | | | Steel of inv. |
| V | 0.10 | 1.00 | 1.20 | 0.04 | | | | | 0.03 | | | Steel of inv. |
| W | 0.10 | 1.00 | 1.20 | 0.03 | | | | | | 0.03 | | Steel of inv. |
| X | 0.10 | 1.00 | 1.20 | 0.04 | | | | | | 0.01 | 0.05 | Steel of inv. |
| Y | 0.10 | 1.00 | 1.20 | 0.03 | | | | | 0.02 | 0.03 | | Steel of inv. |
| Z | 0.10 | 1.20 | 3.20 | 0.02 | | | | | | | | Comp. steel |

| No. | Steel | Ac1 | Ac3 | TC | CR % | TS °C. | ts sec | CR1 °C./sec | Tq °C. | CR2 °C./sec | Tc °C. | Tb °C. | tb sec | Ts MPa | Vg % |
|---|---|---|---|---|---|---|---|---|---|---|---|---|---|---|---|
| 1 | A | 742 | 884 | 1150 | 67 | 790 | 90 | 5 | 670 | 80 | 400 | 400 | 300 | 464 | 0.8 |
| 2 | B | 761 | 903 | 1150 | 67 | 800 | 90 | 5 | 670 | 80 | 400 | 400 | 300 | 594 | 3.4 |
| 3 | C | 758 | 886 | 1150 | 80 | 790 | 90 | 5 | 670 | 80 | 400 | 400 | 300 | 693 | 5.0 |
| 4 | D | 707 | 796 | 1150 | 67 | 790 | 90 | 5 | 670 | 80 | 400 | 400 | 300 | 548 | 0.0 |
| 5 | E | 742 | 856 | 1150 | 40 | 800 | 90 | 5 | 670 | 80 | 400 | 400 | 300 | 604 | 7.1 |
| 6 | F | 751 | 869 | 1150 | 50 | 790 | 90 | 80 | 670 | 80 | 400 | 400 | 300 | 690 | 6.8 |
| 7 | F | 751 | 869 | 1150 | 60 | 790 | 90 | 5 | 670 | 80 | 400 | 400 | 300 | 692 | 7.2 |
| 8 | F | 751 | 869 | 1150 | 67 | 790 | 90 | 80 | 670 | 80 | 270 | 400 | 300 | 685 | 6.3 |
| 9 | F | 751 | 869 | 1150 | 80 | 790 | 90 | 5 | 670 | 80 | 270 | 400 | 300 | 682 | 7.2 |
| 10 | F | 751 | 869 | 1050 | 67 | 790 | 90 | 5 | 670 | 80 | 400 | 400 | 300 | 702 | 5.2 |
| 11 | F | 751 | 869 | 1150 | 25 | 790 | 90 | 5 | 670 | 80 | 400 | 400 | 300 | 635 | 2.1 |
| 12 | F | 751 | 869 | 1150 | 67 | 700 | 90 | 5 | 670 | 80 | 400 | 400 | 300 | 662 | 0.0 |
| 13 | F | 751 | 869 | 1150 | 67 | 920 | 90 | 5 | 670 | 80 | 400 | 400 | 300 | 677 | 0.8 |
| 14 | F | 751 | 869 | 1150 | 67 | 790 | 12 | 5 | 670 | 80 | 400 | 400 | 300 | 626 | 0.5 |
| 15 | F | 751 | 869 | 1150 | 67 | 790 | 90 | 0.8 | 670 | 0.8 | 400 | 400 | 300 | 651 | 0.0 |
| 16 | F | 751 | 869 | 1150 | 67 | 790 | 90 | 5 | 670 | 0.8 | 400 | 400 | 300 | 659 | 0.0 |
| 17 | F | 751 | 869 | 1150 | 80 | 490 | 90 | 5 | 500 | 80 | 270 | 400 | 300 | 743 | 2.8 |
| 18 | F | 751 | 869 | 1150 | 67 | 790 | 90 | 5 | 670 | 80 | 230 | 230 | 300 | 687 | 1.0 |
| 19 | F | 751 | 869 | 1150 | 67 | 790 | 90 | 5 | 670 | 80 | 520 | 520 | 300 | 682 | 1.3 |
| 20 | F | 751 | 869 | 1150 | 67 | 790 | 90 | 5 | 670 | 80 | 400 | 400 | 4 | 636 | 13.1 |
| 21 | F | 751 | 869 | 1150 | 67 | 790 | 90 | 5 | 670 | 80 | 400 | 400 | 1800 | 639 | 0.0 |
| 22 | F | 751 | 869 | 1150 | 67 | 790 | 90 | 5 | 670 | 80 | 400 | 400 | 300 | 656 | 0.9 |
| 23 | F | 751 | 869 | 1150 | 80 | 790 | 90 | 3 | 670 | 80 | 400 | 400 | 300 | 651 | 7.7 |
| 24 | F | 751 | 869 | 1150 | 50 | 790 | 90 | 5 | 700 | 80 | 300 | 400 | 300 | 671 | 5.8 |
| 25 | F | 751 | 869 | 1150 | 70 | 790 | 90 | 5 | 670 | 80 | 400 | 400 | 800 | 674 | 4.9 |
| 26 | F | 751 | 869 | 1150 | 60 | 790 | 90 | 5 | 560 | 80 | 350 | 350 | 300 | 684 | 5.5 |
| 27 | G | 800 | 945 | 1150 | 40 | 810 | 90 | 5 | 620 | 80 | 400 | 400 | 300 | 893 | 5.8 |
| 28 | H | 747 | 854 | 1150 | 67 | 790 | 90 | 5 | 670 | 80 | 400 | 400 | 300 | 739 | 12.8 |
| 29 | H | 747 | 854 | 1150 | 67 | 700 | 90 | 5 | 670 | 80 | 400 | 400 | 300 | 690 | 0.0 |
| 30 | H | 747 | 854 | 1150 | 67 | 890 | 90 | 5 | 670 | 80 | 400 | 400 | 300 | 733 | 1.2 |
| 31 | I | 751 | 843 | 1150 | 67 | 790 | 90 | 5 | 670 | 80 | 400 | 400 | 300 | 877 | 15.8 |
| 32 | J | 759 | 849 | 1150 | 67 | 790 | 90 | 5 | 670 | 80 | 400 | 400 | 300 | 942 | 17.6 |
| 33 | K | 737 | 790 | 1150 | 67 | 780 | 90 | 5 | 670 | 80 | 400 | 400 | 300 | 1092 | 18.2 |
| 34 | L | 742 | 798 | 1150 | 67 | 790 | 90 | 5 | 670 | 80 | 400 | 400 | 300 | 1093 | 16.9 |
| 35 | M | 708 | 824 | 1150 | 67 | 790 | 90 | 5 | 670 | 80 | 400 | 400 | 300 | 526 | 4.2 |
| 36 | N | 708 | 869 | 1150 | 67 | 790 | 90 | 5 | 670 | 80 | 400 | 400 | 300 | 498 | 5.0 |
| 37 | O | 722 | 866 | 1150 | 67 | 790 | 90 | 5 | 670 | 80 | 400 | 400 | 300 | 732 | 8.3 |
| 38 | P | 745 | 902 | 1150 | 67 | 790 | 90 | 5 | 670 | 80 | 400 | 400 | 300 | 818 | 13.7 |

-continued

| | | | | | | | | | | | | | | | |
|---|---|---|---|---|---|---|---|---|---|---|---|---|---|---|---|
| 39 | Q | 746 | 881 | 1150 | 67 | 790 | 90 | 5 | 670 | 80 | 400 | 400 | 300 | 610 | 6.7 |
| 40 | R | 761 | 879 | 1150 | 67 | 800 | 90 | 5 | 670 | 80 | 400 | 400 | 300 | 604 | 5.9 |
| 41 | S | 710 | 796 | 1150 | 67 | 790 | 90 | 5 | 670 | 80 | 400 | 400 | 300 | 534 | 6.4 |
| 42 | T | 760 | 868 | 1150 | 67 | 800 | 90 | 5 | 670 | 80 | 400 | 400 | 300 | 613 | 4.2 |
| 43 | U | 747 | 896 | 1150 | 67 | 790 | 90 | 5 | 670 | 80 | 400 | 400 | 300 | 565 | 4.6 |
| 44 | U' | 748 | 880 | 1150 | 67 | 790 | 90 | 5 | 670 | 80 | 400 | 400 | 300 | 568 | 4.0 |
| 45 | V | 739 | 856 | 1150 | 67 | 790 | 90 | 5 | 670 | 80 | 400 | 400 | 300 | 598 | 4.4 |
| 46 | W | 739 | 868 | 1150 | 67 | 790 | 90 | 5 | 670 | 80 | 400 | 400 | 300 | 626 | 4.0 |
| 47 | X | 739 | 965 | 1150 | 67 | 790 | 90 | 5 | 670 | 80 | 400 | 400 | 300 | 576 | 7.0 |
| 48 | Y | 739 | 868 | 1150 | 67 | 0790 | 90 | 5 | 670 | 80 | 400 | 400 | 300 | 627 | 5.3 |
| 49 | Z | 724 | 804 | 1150 | 67 | 790 | 90 | 5 | 670 | 80 | 400 | 400 | 300 | 707 | 7.0 |

| No. | Steel | Vp % | Vs % | Cg % | Vb % | Vm % | Hf | Vg/C | Vp/Vs | Vg{300(2750 Cg + 600)/(HfVf + HbV b + HmVm) − 1} | T value | Season cracking | Remarks |
|---|---|---|---|---|---|---|---|---|---|---|---|---|---|
| 1 | A | 0.2 | 0.4 | * | 0.9 | 0.0 | 182 | 27 | 0.40 | * | 5 | OK | Comp. steel |
| 2 | B | 0.7 | 1.5 | 1.34 | 3.7 | 1.8 | 207 | 68 | 0.49 | 221 | 37 | OK | Steel of inv. |
| 3 | C | 1.2 | 2.3 | 1.53 | 5.3 | 1.3 | 222 | 63 | 0.54 | 318 | 47 | OK | Steel of inv. |
| 4 | D | 0.0 | 0.0 | * | 0.0 | 0.0 | 178 | 0 | — | * | ** | OK | Comp. steel |
| 5 | E | 1.4 | 4.0 | 1.53 | 8.7 | 2.3 | 205 | 71 | 0.34 | 469 | 53 | OK | Steel of inv. |
| 6 | F | 1.2 | 3.3 | 1.36 | 7.2 | 1.9 | 230 | 68 | 0.37 | 375 | 41 | OK | Steel of inv. |
| 7 | F | 1.7 | 4.1 | 1.44 | 7.7 | 2.3 | 233 | 72 | 0.43 | 409 | 55 | OK | Steel of inv. |
| 8 | F | 1.3 | 4.3 | 1.61 | 7.7 | 1.9 | 234 | 68 | 0.31 | 428 | 52 | OK | Steel of inv. |
| 9 | F | 1.8 | 4.5 | 1.42 | 8.0 | 2.2 | 221 | 72 | 0.40 | 422 | 51 | OK | Steel of inv. |
| 10 | F | 0.9 | 2.8 | 1.51 | 5.4 | 0.6 | 357 | 52 | 0.34 | 214 | 10 | NG | Comp. steel |
| 11 | F | 0.5 | 0.5 | 1.10 | 2.5 | 0.0 | 220 | 21 | 1.00 | 101 | 24 | NG | Comp. steel |
| 12 | F | 0.0 | 0.0 | * | 0.0 | 0.0 | 207 | 0 | — | * | ** | OK | Comp. steel |
| 13 | F | 0.1 | 0.5 | * | 0.9 | 0.0 | 220 | 8 | 0.30 | * | 0 | OK | Comp. steel |
| 14 | F | 0.1 | 0.3 | * | 0.6 | 0.0 | 206 | 5 | 0.45 | * | ** | OK | Comp. steel |
| 15 | F | 0.0 | 0.0 | * | 0.0 | 0.0 | 222 | 0 | — | * | ** | OK | Comp. steel |
| 16 | F | 0.0 | 0.0 | * | 0.0 | 0.0 | 216 | 0 | — | * | ** | OK | Comp. steel |
| 17 | F | 0.7 | 1.6 | 0.83 | 12.0 | 4.9 | 248 | 28 | 0.46 | 84 | 5 | NG | Comp. steel |
| 18 | F | 0.2 | 0.2 | 0.81 | 1.2 | 0.0 | 225 | 10 | 1.00 | 37 | 3 | NG | Comp. steel |
| 19 | F | 0.3 | 0.3 | 0.89 | 1.4 | 0.0 | 217 | 13 | 0.83 | 54 | 1 | NG | Comp. steel |
| 20 | F | 0.8 | 0.9 | 0.79 | 1.0 | 24.3 | 236 | 131 | 0.89 | 284 | 36 | NG | Comp. steel |
| 21 | F | 0.0 | 0.0 | * | 0.0 | 0.0 | 215 | 0 | — | * | ** | OK | Comp. steel |
| 22 | F | 0.2 | 0.5 | * | 1.0 | 0.0 | 200 | 9 | 0.36 | * | 2 | OK | Comp. steel |
| 23 | F | 1.5 | 4.9 | 1.47 | 8.9 | 3.0 | 225 | 77 | 0.31 | 451 | 59 | OK | Steel of inv. |
| 24 | F | 1.2 | 2.6 | 1.33 | 7.2 | 0.9 | 227 | 58 | 0.44 | 323 | 43 | OK | Steel of inv. |
| 25 | F | 1.0 | 2.8 | 1.42 | 5.2 | 0.5 | 207 | 49 | 0.35 | 319 | 43 | OK | Steel of inv. |
| 26 | F | 1.0 | 2.8 | 1.49 | 5.8 | 0.7 | 234 | 55 | 0.35 | 331 | 38 | OK | Steel of inv. |
| 27 | G | 1.5 | 3.1 | 1.34 | 6.5 | 0.9 | 271 | 58 | 0.48 | 278 | 37 | OK | Steel of inv. |
| 28 | H | 2.4 | 5.8 | 1.47 | 14.4 | 3.4 | 237 | 80 | 0.42 | 737 | 75 | OK | Steel of inv. |
| 29 | H | 0.0 | 0.0 | * | 0.0 | 0.0 | 219 | 0 | — | * | ** | OK | Comp. steel |
| 30 | H | 0.3 | 0.7 | * | 1.3 | 0.0 | 240 | 8 | 0.39 | * | 0 | OK | Comp. steel |
| 31 | I | 3.5 | 10.3 | 1.35 | 17.5 | 3.3 | 277 | 79 | 0.34 | 777 | 74 | OK | Steel of inv. |
| 32 | J | 4.1 | 11.5 | 1.57 | 18.9 | 2.8 | 320 | 77 | 0.36 | 924 | 72 | OK | Steel of inv. |
| 33 | K | 3.5 | 40 | 1.03 | 20.2 | 0.9 | 364 | 57 | 0.88 | 629 | 63 | OK | Comp. steel |
| 34 | L | 3.7 | 39 | 0.89 | 19.3 | 0.4 | 355 | 47 | 0.95 | 522 | 54 | OK | Comp. steel |
| 35 | M | 0.8 | 2.4 | 1.60 | 5.2 | 0.3 | 156 | 42 | 0.32 | 391 | 45 | OK | Steel of inv. |
| 36 | N | 1.0 | 2.5 | 1.57 | 5.1 | 0.5 | 164 | 50 | 0.38 | 438 | 49 | OK | Steel of inv. |
| 37 | O | 1.9 | 4.0 | 1.51 | 10.3 | 0.3 | 237 | 44 | 0.47 | 516 | 60 | OK | Steel of inv. |
| 38 | P | 3.3 | 6.2 | 1.53 | 15.2 | 2.3 | 260 | 72 | 0.54 | 791 | 74 | OK | Steel of inv. |
| 39 | Q | 1.2 | 4.2 | 1.55 | 7.0 | 1.8 | 213 | 67 | 0.29 | 443 | 51 | OK | Steel of inv. |
| 40 | R | 1.2 | 3.7 | 1.49 | 7.1 | 1.1 | 203 | 59 | 0.34 | 400 | 57 | OK | Steel of inv. |
| 41 | S | 0.3 | 3.6 | 1.56 | 7.8 | 1.4 | 192 | 64 | 0.35 | 467 | 51 | OK | Steel of inv. |
| 42 | T | 0.8 | 2.6 | 1.57 | 4.5 | 0.3 | 198 | 42 | 0.30 | 312 | 44 | OK | Steel of inv. |
| 43 | U | 1.0 | 2.8 | 1.57 | 5.3 | 0.4 | 173 | 46 | 0.35 | 384 | 54 | OK | Steel of inv. |
| 44 | U' | 1.0 | 2.1 | 1.55 | 6.8 | 1.0 | 170 | 40 | 0.47 | 321 | 40 | OK | Steel of inv. |
| 45 | V | 1.1 | 2.3 | 1.53 | 4.5 | 0.3 | 208 | 44 | 0.45 | 305 | 41 | OK | Steel of inv. |
| 46 | W | 0.7 | 2.3 | 1.52 | 4.7 | 0.2 | 209 | 40 | 0.30 | 274 | 41 | OK | Steel of inv. |
| 47 | X | 1.6 | 3.3 | 1.51 | 8.5 | 2.0 | 183 | 70 | 0.48 | 506 | 49 | OK | Steel of inv. |
| 48 | Y | 1.1 | 2.3 | 1.51 | 5.5 | 0.7 | 202 | 53 | 0.47 | 370 | 46 | OK | Steel of inv. |
| 49 | Z | 1.5 | 1.5 | 0.68 | 8.4 | 2.0 | 218 | 70 | 1.00 | 225 | 6 | NG | Comp. steel |

INDUSTRIAL APPLICABILITY

As is apparent from the foregoing description, the present invention can provide a steel sheet which has high strength and excellent deep drawability, needs no large forming load for the strength, and is less likely to cause galling, and which, when applied to parts of automobiles, can greatly contribute to an improvement in reduction of the weight of the body, an improvement in safety at the time of collision of automobiles, and an improvement in productivity.

We claim:

1. A high-strength steel sheet suitable for deep drawing, characterized by comprising 0.04 to 0.25 mass % of C and 0.3 to 3.0 mass % in total of at least one of Si and Al with the balance consisting of Fe and unavoidable impurities, said steel sheet having a composite structure comprising ferrite as a main phase (a phase having the highest volume fraction), not less than 3 vol. % of austenite, and bainite and martensite as unavoidable phases;

said steel having multiple phases having a ratio of a volume fraction of austenite Vp (vol. %) (which is a volume fraction of austenite remaining when plane strain tensile deformation (strain ratio=(minimum principal strain within plane)/(maximum principal strain within plane)=0) is applied until a equivalent plastic strain of 1.15 times Eu (logarithmic strain of uniform elongation in the case of uniaxial tension) is imparted) to a volume fraction of austenite Vs (vol. %) (which is a volume fraction of austenite remaining when shrinkage flange deformation (strain ratio=−4 to −1) is applied until a equivalent plastic strain of 1.15 Eu is imparted), Vp/Vs, of not more than 0.8; and said steel having multiple phases satisfying a requirement represented by the following formula $$200<Vg\{300(2750Cg+600)/(HfVf+HbVb+HmVm)-1\}<990$$

wherein Vg represents the volume fraction of austenite before working (vol. %); Cg represents the content of C in the austenite (mass %); Vf represents the volume fraction of ferrite before working; Hf represents the microvickers hardness of the ferrite; Vb represents the volume fraction of bainite before working (vol. %); Hb represents the hardness of the bainite; Vb represents the volume fraction of martensite before working (vol. %); and Hm represents the hardness of the martensite.

2. The high-strength steel sheet according to claim 1, wherein in said composite structure a value obtained by dividing the volume fraction Vg (vol. %) of austenite before working by the content of C (mass %) contained in the whole steel, Vg/C, is in the range of from 40 to 140.

3. The high-strength steel sheet according to claim 1, which further comprises 0.5 to 3.5 mass % in total of at least one member selected from Mn, Ni, Cu, Cr, and Mo.

4. The high-strength steel sheet according to claim 1, which further comprises not more than 0.20 mass % in total of at least one member selected from Nb, Ti, V, and P.

5. The high-strength steel sheet according to claim 1, which further comprises 0.5 to 3.5 mass % in total of at least one member selected from Mn, Ni, Cr, and Mo and 0.20 mass % in total of at least one member selected from Nb, Ti, V, and P.

6. A process for producing a high-strength steel sheet suitable for deep drawing, characterized by comprising the steps of:

casting a molten steel, comprising 0.04 to 0.25 mass % of C and 0.3 to 3.0 mass % in total of at least one of Si and Al with the balance consisting of Fe and unavoidable impurities, into a slab;

either once cooling and then heating the slab to a temperature above 1100° C. or ensuring a temperature above 1100° C. on the inlet side of rough rolling without cooling to carry out hot rolling;

coiling the resultant hot-rolled strip at a temperature in the range of from 350° to 750° C.;

cold-rolling the hot-rolled steel strip with a reduction ratio of 35 to 85%; and transferring the cold-rolled steel strip into a continuous annealing furnace where the cold-rolled steel strip is heated in the temperature range of from $A_{C1}$ to $A_{C3}$ for 30 sec to 5 min, cooled to 550° to 720° C. at a cooling rate of 1° to 200° C./sec, further cooled to the temperature range of from 250° to 500° C. at a cooling rate of from 10° to 200° C./sec, held in the temperature range of from 300° to 500° C. for 15 sec to 15 min, and then cooled to room temperature.

7. The process for producing a high-strength steel sheet according to claim 6, wherein in the annealing furnace the cold-rolled steel strip is heated in the temperature range of from $A_{C1}$ to $A_{C3}$ for 30 sec to 5 min and then cooled to the temperature range of from 550° to 720° C. at a cooling rate of 1° to 10° C./sec.

8. The process for producing a high-strength steel sheet according to claim 6, wherein, after the cold-rolled steel strip in the annealing furnace is cooled to a temperature in the range of from 250° to below 500° C. at a cooling rate of 10° to 200° C./sec, it is held for 15 sec to 15 min in the temperature range of from 300° to 500° C. and at a temperature above the cooling termination temperature.

9. The process for producing a high-strength steel sheet according to claim 6, wherein said steel further comprises 0.5 to 3.5 mass % in total of at least one member selected from Mn, Ni, Cu, Cr, and Mo.

10. The process for producing a high-strength steel sheet according to claim 6, wherein said steel further comprises 0.20 mass %, in total, of at least one member selected from Nb, Ti, V, and P.

11. The process for producing a high-strength steel sheet according to claim 6, wherein said steel further comprises 0.5 to 3.5 mass %, in total, of at least one member selected from Mn, Ni, Cr, and Mo and 0.20 mass %, in total, of at least one member selected from Nb, Ti, V, and P.

* * * * *

UNITED STATES PATENT AND TRADEMARK OFFICE

CERTIFICATE OF CORRECTION

PATENT NO. : 5,618,355

DATED : April 8, 1997

INVENTOR(S) : Kazuo KOYAMA, et al.

It is certified that error appears in the above-indentified patent and that said Letters Patent is hereby corrected as shown below:

ABSTRACT, line 4, change "phases" to --phase--.

Column 3, line 20, change "almost" to --mostly--.

Column 3, line 42, delete "a".

Column 4, line 22, delete "a".

Column 4, line 37, change "a" to --an--.

Column 5, line 44, change "sufficiently soft" to --sufficient softness--.

Column 6, line 32, insert --be-- after "will".

Column 7, line 21, change "a" to --an--.

Column 7, line 64, change "a" to --an--.

Column 8, line 24, insert --the-- before "effect".

Column 9, line 34, change "unnecessary" to --unnecessarily--.

Column 9, line 60, change "...)-1)." to --...)-1}.--.

Column 10, line 15, change "...)-1)." to --...)-1}.--.

UNITED STATES PATENT AND TRADEMARK OFFICE

CERTIFICATE OF CORRECTION

PATENT NO. : 5,618,355

DATED : April 8, 1997

INVENTOR(S) : Kazuo KOYAMA, et al.

It is certified that error appears in the above-indentified patent and that said Letters Patent is hereby corrected as shown below:

Column 10, line 31, change "element" to --elements--.

Column 12, line 24, change "$A_{C1}$ to $A_{C3}$." to --$AC_1$ to $AC_3$.--.

Column 12, line 26, change "$A_{C3,}$" to --$AC_{3,}$--.

Column 12, line 29, change "$A_{C1}$ and $A_{C3}$." to --$AC_1$ and $AC_3$.--

Columns 15 and 16, insert --TABLE 2-- above the second table.

Column 15, column 7 of Table 2, No. 5, change "800" to --790.--.

Column 17, No. 47, change "965" to --865--. (1st occ.)

Column 17, No. 48, change "0790" to --790--. (1st occ.)

Column 17, Table 2, No. 41, change "0.3" to --1.3--. (2nd occ.)

UNITED STATES PATENT AND TRADEMARK OFFICE

CERTIFICATE OF CORRECTION

PATENT NO. : 5,618,355

DATED : April 8, 1997

INVENTOR(S) : Kazuo KOYAMA, et al.

It is certified that error appears in the above-indentified patent and that said Letters Patent is hereby corrected as shown below:

Column 19, line 6, change "imparted)" to --imparted--.

Column 19, line 23, change "Vb" to --Vm--.

Signed and Sealed this

Ninth Day of September, 1997

*Attest:*

*Attesting Officer*

BRUCE LEHMAN

*Commissioner of Patents and Trademarks*